US010314357B2

(12) United States Patent
Hoffman et al.

(10) Patent No.: US 10,314,357 B2
(45) Date of Patent: Jun. 11, 2019

(54) ANATOMY SHADING FOR GARMENTS

(71) Applicant: VF Corporation, Greensboro, NC (US)

(72) Inventors: Donald Hoffman, Irvine, CA (US); Darren J. Peshek, Irvine, CA (US); Stephen F. Dull, Greensboro, NC (US); Stephen H. Zades, Winston Salem, NC (US); Robin O'Neill Fisher, Atlanta, GA (US); Justin T. Mark, Irvine, CA (US); Brian Marion, Irvine, CA (US)

(73) Assignee: VF Corporation, Greensboro, NC (US)

( * ) Notice: Subject to any disclaimer, the term of this patent is extended or adjusted under 35 U.S.C. 154(b) by 380 days.

(21) Appl. No.: 15/213,793

(22) Filed: Jul. 19, 2016

(65) Prior Publication Data

US 2016/0324234 A1 Nov. 10, 2016

Related U.S. Application Data

(63) Continuation-in-part of application No. 14/517,339, filed on Oct. 17, 2014.

(60) Provisional application No. 61/892,749, filed on Oct. 18, 2013.

(51) Int. Cl.

| | |
|---|---|
| ***G06K 9/00*** | (2006.01) |
| ***A41H 3/04*** | (2006.01) |
| ***A41D 1/06*** | (2006.01) |

(52) U.S. Cl.

CPC ..... *A41H 3/04* (2013.01); *A41D 1/06* (2013.01); *A41D 2400/38* (2013.01)

(58) Field of Classification Search

None

See application file for complete search history.

(56) References Cited

U.S. PATENT DOCUMENTS

| | | | |
|---|---|---|---|
| 407,024 | A | 7/1889 | Miller |
| 564,373 | A | 7/1896 | Goodman |
| 693,276 | A | 2/1902 | Klavinsky |
| 1,654,064 | A | 12/1927 | Zaki |
| 1,697,255 | A | 1/1929 | Wolff |
| 1,817,053 | A | 8/1931 | Zerk |
| 1,852,138 | A | 4/1932 | Zerk |
| 2,381,580 | A | 8/1945 | Einbinder |

(Continued)

FOREIGN PATENT DOCUMENTS

| | | |
|---|---|---|
| CN | 3546110 | 7/2006 |
| CN | 301869010 | 3/2010 |

(Continued)

OTHER PUBLICATIONS

"How to Find the Perfect Skinny Jeans", Aug. 29, 2012, denimblog.com, site visited Feb. 9, 2017, <http://www.denimblog.com/2012/08/how-to-find-the-perfect-skinny-jeans/>, 2 pgs.

(Continued)

*Primary Examiner* — Delomia L Gilliard

(74) *Attorney, Agent, or Firm* — Smith, Gambrell & Russell LLP

(57) ABSTRACT

Systems and methods for anatomy shading and the garments that result therefrom are provided herein. More specifically, anatomy shading is any deliberate manipulation or addition of shading (a brightness gradient) to a garment in order to change the perceived shape of a wearer of the garment toward a desired appearance.

20 Claims, 16 Drawing Sheets

(56) References Cited

U.S. PATENT DOCUMENTS

| | | | |
|---|---|---|---|
| 2,718,640 | A | 9/1955 | Suckle |
| 2,840,824 | A | 7/1958 | Horner |
| 3,683,419 | A | 8/1972 | Lewis |
| 3,691,971 | A | 9/1972 | Clarke |
| 3,696,845 | A | 10/1972 | Acker et al. |
| D259,820 | S | 7/1981 | Heinfling |
| 4,282,609 | A | 8/1981 | Freedman et al. |
| D263,766 | S | 4/1982 | Heinfling |
| D278,376 | S | 4/1985 | Heinfling |
| D278,377 | S | 4/1985 | Heinfling |
| D278,471 | S | 4/1985 | Heinfling |
| 4,888,713 | A | 12/1989 | Falk |
| 5,065,458 | A | 11/1991 | Johnson |
| 5,535,451 | A | 7/1996 | Tassone |
| 5,990,444 | A | 11/1999 | Costin |
| 6,175,966 | B1 | 1/2001 | Wiesenthal |
| D483,924 | S | 12/2003 | Morisset |
| D511,606 | S | 11/2005 | Caucci |
| 7,058,987 | B2 | 6/2006 | Salazar |
| D528,742 | S | 9/2006 | Langmantel |
| 7,107,621 | B2 | 9/2006 | Meekins |
| D532,958 | S | 12/2006 | Kent |
| D558,954 | S | 1/2008 | Lew |
| D584,487 | S | 1/2009 | Maimon |
| D586,084 | S | 2/2009 | Mendoza |
| D592,829 | S | 5/2009 | Kepekchyan |
| D600,882 | S | 9/2009 | Johnson, Jr. |
| 7,814,576 | B2 | 10/2010 | Nakazawa |
| D650,154 | S | 12/2011 | Saavedra |
| D686,800 | S | 7/2013 | Kelly |
| 8,869,313 | B2 | 10/2014 | Maramotti |
| 8,959,665 | B1 | 2/2015 | Garner |
| 8,984,668 | B2 | 3/2015 | Tulin |
| D732,801 | S | 6/2015 | Magevonna |
| D733,398 | S | 7/2015 | Ellis |
| D735,973 | S | 8/2015 | Hodis |
| 9,326,552 | B2 | 5/2016 | Hays |
| D758,695 | S | 6/2016 | Lago |
| D758,696 | S | 6/2016 | Castellan |
| D762,072 | S | 7/2016 | Greenstein |
| D764,755 | S | 8/2016 | Urban et al. |
| D768,359 | S | 10/2016 | Lago |
| D769,579 | S | 10/2016 | Griffin |
| 9,468,239 | B2 | 10/2016 | Battah |
| D770,728 | S | 11/2016 | Jaklinski |
| D793,033 | S | 8/2017 | Neary |
| 9,801,420 | B2 | 10/2017 | Hays |
| D802,256 | S | 11/2017 | Peshek |
| 2004/0205879 | A1 | 10/2004 | Leba |
| 2006/0235656 | A1 | 10/2006 | Mochimaru et al. |
| 2007/0266478 | A1 | 11/2007 | Girod |
| 2008/0271226 | A1 | 11/2008 | Erana |
| 2009/0144173 | A1* | 6/2009 | Mo ..... G06N 3/006 705/26.1 |
| 2009/0157021 | A1 | 6/2009 | Sullivan et al. |
| 2010/0064409 | A1 | 3/2010 | Buckley |
| 2010/0136882 | A1 | 6/2010 | Malish |
| 2010/0192283 | A1 | 8/2010 | Kim |
| 2011/0010818 | A1 | 1/2011 | Hood |
| 2011/0185477 | A1 | 8/2011 | Olenicoff |
| 2011/0214216 | A1 | 9/2011 | Zarabi |
| 2012/0023644 | A1 | 2/2012 | Maramotti |
| 2013/0219589 | A1 | 8/2013 | Jones |
| 2014/0035913 | A1* | 2/2014 | Higgins ..... G06T 17/00 345/420 |
| 2014/0096309 | A1 | 4/2014 | Hughes |
| 2014/0150166 | A1 | 6/2014 | Hall |
| 2014/0165265 | A1 | 6/2014 | Tulin |
| 2014/0182044 | A1 | 7/2014 | Cole |
| 2014/0273742 | A1 | 9/2014 | Hays |
| 2015/0082516 | A1 | 3/2015 | Doan |
| 2015/0106993 | A1* | 4/2015 | Hoffman ..... A41D 1/06 2/69 |
| 2015/0196068 | A1 | 7/2015 | Tulin |
| 2015/0213646 | A1 | 7/2015 | Ma |
| 2015/0339853 | A1 | 11/2015 | Wolper |
| 2016/0189431 | A1 | 6/2016 | Ueda |
| 2016/0227854 | A1 | 8/2016 | Ellis |
| 2018/0014583 | A1 | 1/2018 | Peshek |
| 2018/0014590 | A1 | 1/2018 | Peshek |
| 2018/0020752 | A1 | 1/2018 | Peshek |
| 2018/0110273 | A1 | 4/2018 | Peshek |
| 2018/0168256 | A1 | 6/2018 | Peshek |

FOREIGN PATENT DOCUMENTS

| | | |
|---|---|---|
| CN | 301600315 | 7/2011 |
| CN | 302245662 | 12/2012 |
| CN | 302245667 | 12/2012 |
| CN | 302554428 | 9/2013 |
| FR | 2876880 | 4/2006 |
| JP | 2004156153 | 6/2004 |
| WO | 2006032096 | 3/2006 |
| WO | 2007055072 | 5/2007 |
| WO | 2007112494 | 10/2007 |
| WO | 2012004365 | 1/2012 |
| WO | 20130154445 | 10/2013 |
| WO | 2018017732 | 1/2018 |

OTHER PUBLICATIONS

"Presto Pockets", Apr. 5, 2011, "Macaroni & Cheese" Blog, visited Feb. 9, 2017, <http://mac-aroni-ncheese.blogspot.com/2011/04/tutorial-presto-pockets.html>.

"Pocket Picker", Jun. 13, 2011, bluemooney.wordpress.com, site visited Feb. 9, 2017, <https://bluemooney.wordpress.com/2011/06/13/pocket-picker/>, 2 pgs.

"Xtreme Gray Butt Li Ft Jeans 32 and 38 Inseam", May 16, 2011, hotsexyfit.com, site visited Feb. 14, 2017, <http://www.hotsexyfit.com/XTREME-GRAY-BUTT-LI FT-JEANS.html>, 2 pgs.

PCT International Search Report in PCT/US2017/042885, dated Sep. 11, 2017, 14 pages.

PCT International Search Report in PCT/US2017/042888, dated Sep. 11, 2017, 15 pages.

PCT Invitiation to Pay Additional Fees in PCT/US2017/0422000, dated Sep. 20, 2017, 15 pages.

"Truly WOW Slim Leg Jeans Long Simply Be", Aug. 1, 2012, 3 pages, http://www.simplybe.co/uk/shop/truly-wow-slimleg-jeans-long.co.uk/shop/truly-wow-slim-leg-jeans-long/qy094/product/details/show.action?pdBoUid=5205#colour;size.

U.S. Appl. No. 29/553,279, 312 Amendment filed Apr. 12, 2017, 10 pages.

Anonymous, "Kilowog muscle suit", Aug. 3, 2010, XP055371226, http://theleagueofheroes.yuku.com. Retreived from the Internet: http://theleagueofheroes.yuku.com/topic9266/Kilowog-muscle-suit#.WRL4-HpMek5, 7 pages.

European Extended Search Report in Application 14854060.2, dated May 18, 2017, 9 pages.

Lee Jeans, The Geek Lounge, Jun. 4, 2014, https://geek.lounge.wordpress.com/tag/lee-jeans.

Men's Jeans and women's jeans and denim jacket measurements to check or make your own pattern, Oct. 11, 2007, https://web.archive.org/web/20071011004827/http://www.jeansinfo.org/measurements.html.

Spoon Graphics, "8 Free Stipple Shading Brushes for Abode Illustrator" May 25, 2015, https://blog.spoongraphics.co.uk/freebies/8-free-stripple-shading-brushes-for-adobe-illustrator.

PCT International Search Report in PCT/US2018/017967, dated Apr. 26, 2018, 14 pages.

PCT International Search Report in PCT/US2017/042200, dated Nov. 28, 2017, 22 pages.

Cuenca-Guerra, et al., "What makes Buttocks Beautiful" A Review and Classification of the Determinants of Gluteal Beauty and the Surgical Techniques to Achieve Them, Aesthetic Plastic Surgery, 2004 Springer Science + Business Media, Inc. 2004.

Hoffman, "Visual Intelligence: How We Create What We See", Published by W.W. Norton, 2000.

(56) References Cited

OTHER PUBLICATIONS

PCT International Search Report in PCT/US2014/061277, dated Jan. 27, 2015, 10 pages.

* cited by examiner

ANATOMY SHADING FOR GARMENTS

RELATED APPLICATIONS

This application claims priority and is a continuation-in-part of pending application Ser. No. 14/517,339, filed Oct. 17, 2014, which claims priority to U.S. Provisional Application Ser. No. 61/892,749, filed Oct. 18, 2013, and are hereby incorporated by reference herein in their entirety.

COPYRIGHT NOTICE

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

INTRODUCTION

It is common for clothing manufacturers to form patterns on jeans that simulate wear or that make another fashion statement. Such patterns are often referred to as "finishes" and are typically formed by manually abrading the jean material or using specialized lasers that remove dye from the outer surface of the material. These finishes form brightness gradients on the jeans. Specifically, areas that have been acted upon will be lighter than areas that have not been acted upon.

The human vision system automatically interprets brightness gradients, such as those formed on jeans, as three-dimensional forms. When the gradients are associated with the human form, human beings automatically assign an attractiveness to the three-dimensional forms. Therefore, when a pair of jeans having a particular finish is worn by an individual, others automatically make determinations as to the attractiveness of the individual's lower body based in part on the nature of the finish.

A problem with existing finishes is that they can actually make the individual's form less attractive to others, a result that is clearly not desired by the individual wearing the garment. It would therefore be desirable to form patterns on jeans, or other garments, that do not reduce the attractiveness of the wearer. Indeed, it would be desirable to form patterns on garments that make the wearer more physically attractive.

SUMMARY

The disclosure is directed to systems and methods for anatomy shading and the garment that result therefrom. More specifically, anatomy shading is any deliberate manipulation and/or addition of shading (a brightness gradient) to a pattern on a garment in order to change the perceived shape of a wearer of the garment toward a desired appearance.

These and various other features as well as advantages will be apparent from a reading of the following detailed description and a review of the associated drawings. Additional features are set forth in the description that follows and, in part, will be apparent from the description, or may be learned by practice of the described embodiments. The benefits and features will be realized and attained by the structure particularly pointed out in the written description and claims hereof as well as the appended drawings.

It is to be understood that both the foregoing general description and the following detailed description are exemplary and explanatory and are intended to provide further explanation of the claimed invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present disclosure may be better understood with reference to the following figures. Matching reference numerals designate corresponding parts throughout the figures, which are not necessarily drawn to scale.

The following drawing figures, which form a part of this application, are illustrative of embodiments systems and methods described below and are not meant to limit the scope of the invention in any manner, which scope shall be based on the claims appended hereto.

Figure 1:
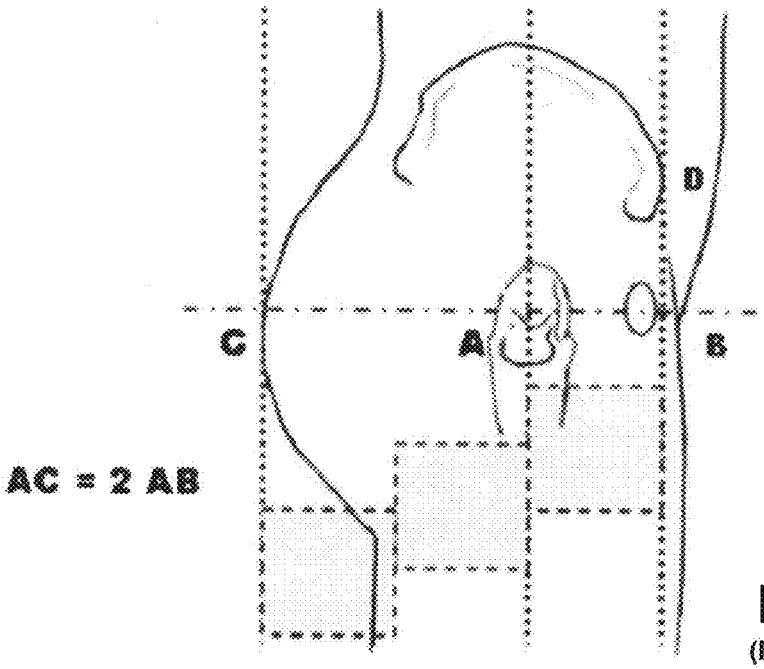
FIG. 1 (PRIOR ART)

FIG. 1 is a schematic diagram of ideal female buttocks and thighs in side view.

Figure 2:
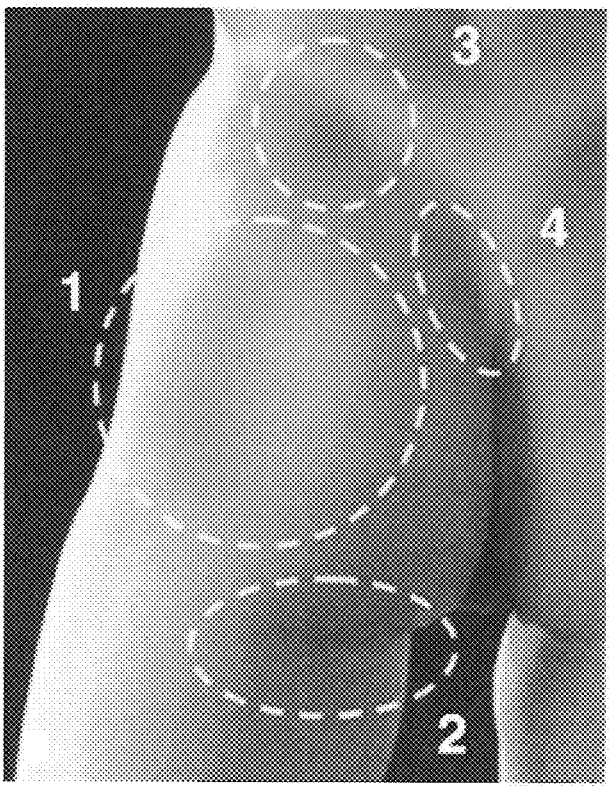
FIG. 2 (PRIOR ART)

FIG. 2 is a photograph of ideal features for female buttocks and thighs in rear view.

Figure 3:
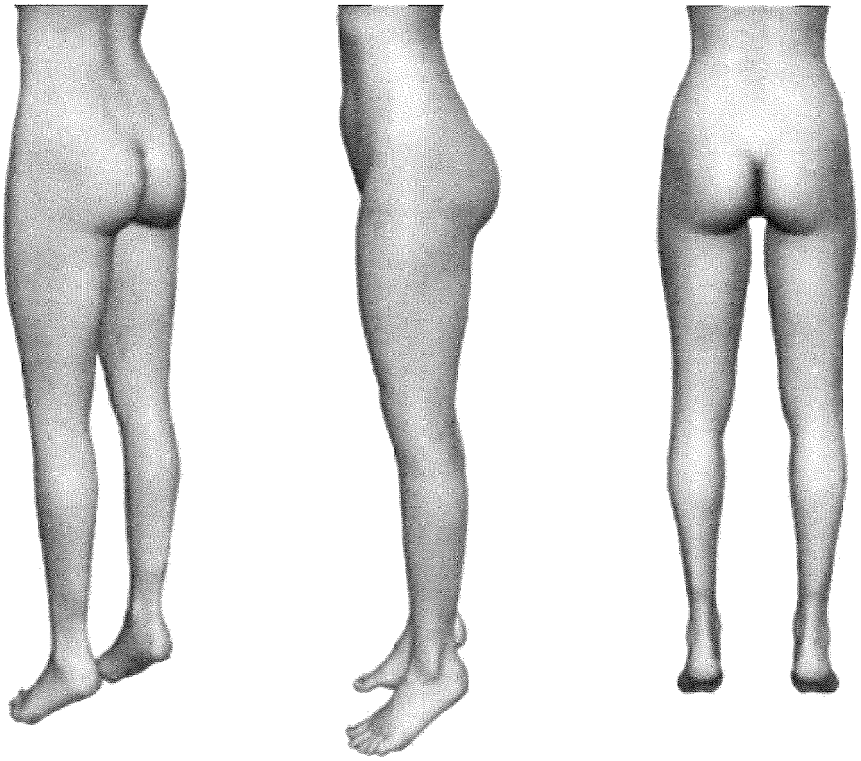

FIG. 3 shows renderings of three-quarter, side, and rear views of an ideal size 2 avatar.

Figure 4:
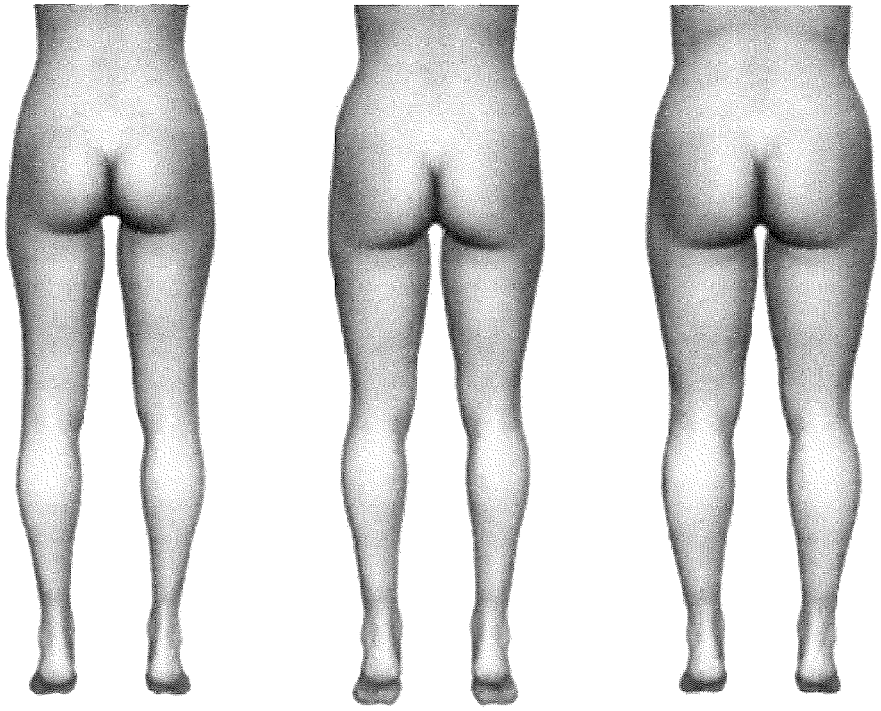

FIG. 4 shows renderings of rear views of ideal size 6, 10, and 14 avatars.

Figure 5:
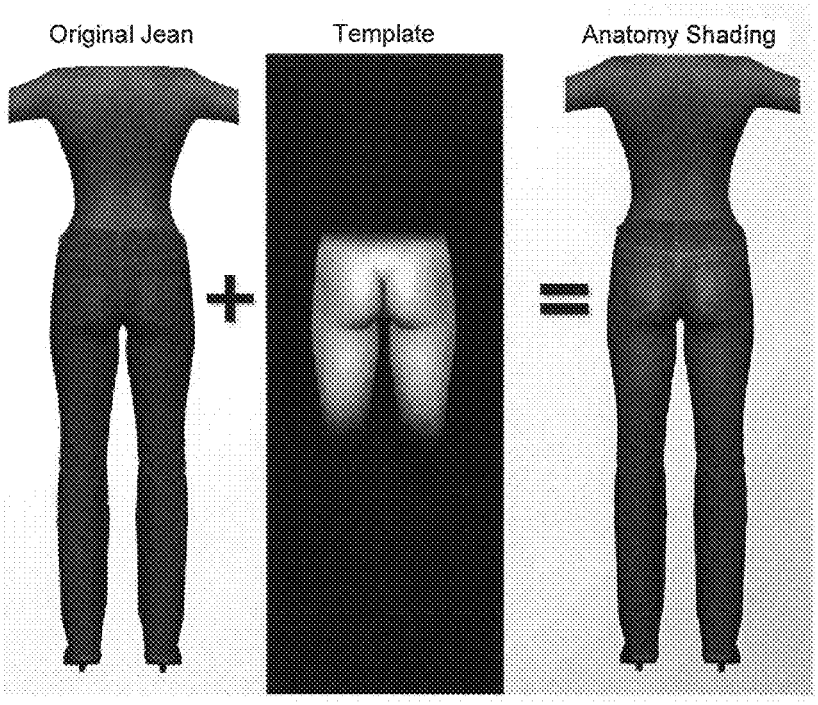

FIG. 5 is schematic illustration of the process of applying a pattern to jeans using a template created from an ideal avatar.

Figure 6:
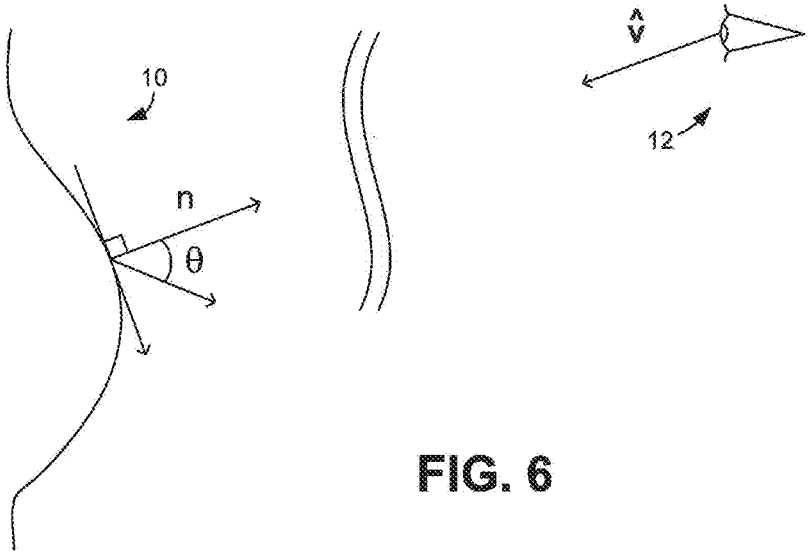

FIG. 6 is a schematic drawing illustrating how the brightness of the pattern varies relative to the perspective of an orthographic viewer.

Figure 7:
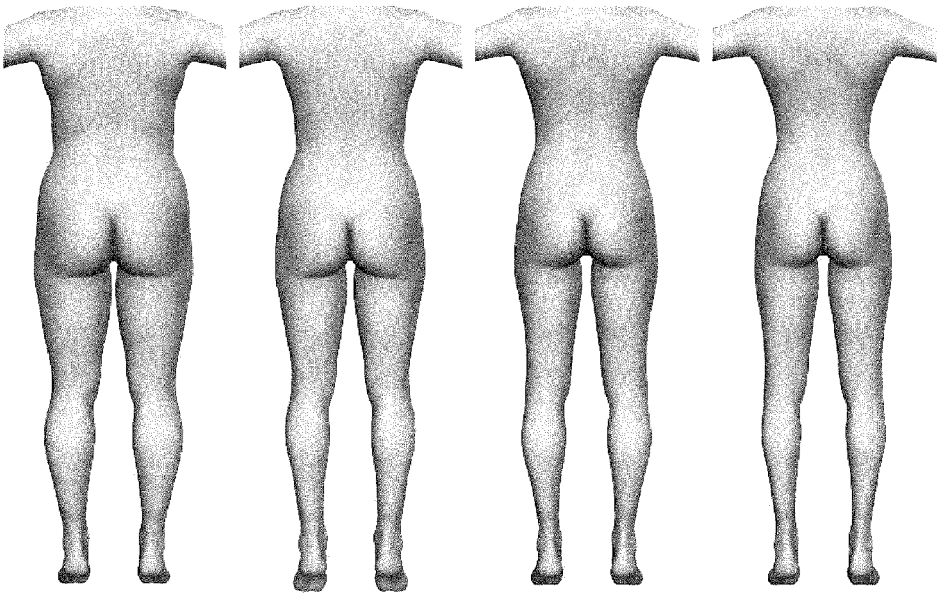

FIG. 7 is a graphical representation of sets of control points C(x, y, and z) for the rear view of ideal size 14, 10, 6, and 2 avatars.

Figure 8:
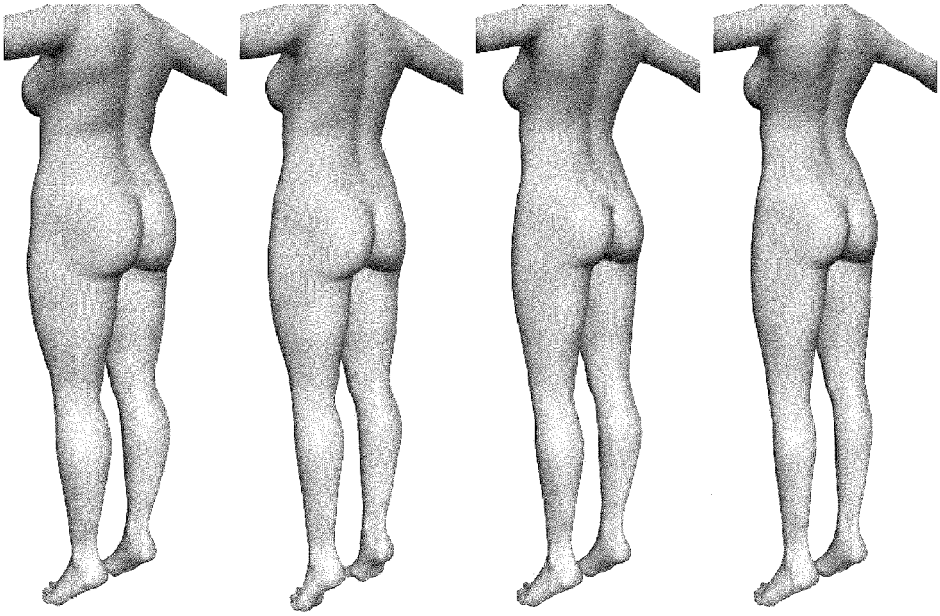

FIG. 8 is a graphical representation of sets of control points C(x, y, and z) for the three quarter view of ideal size 14, 10, 6, and 2 avatars.

Figure 9:
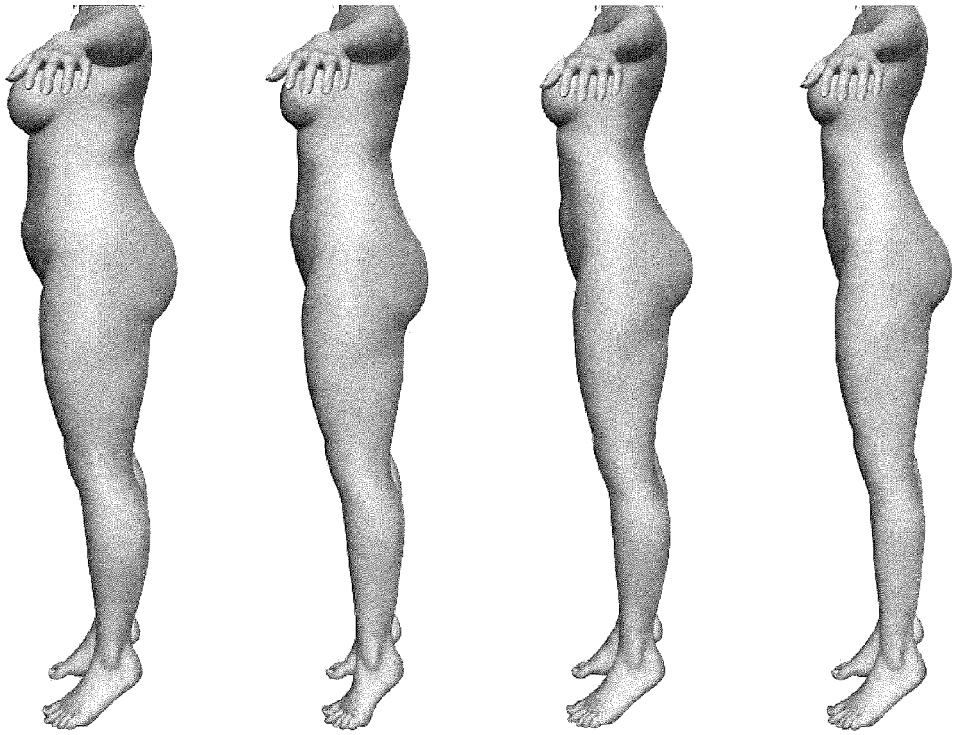

FIG. 9 is a graphical representation of sets of control points C(x, y, and z) for the side view of size ideal 14, 10, 6, and 2 avatars.

Figure 10:
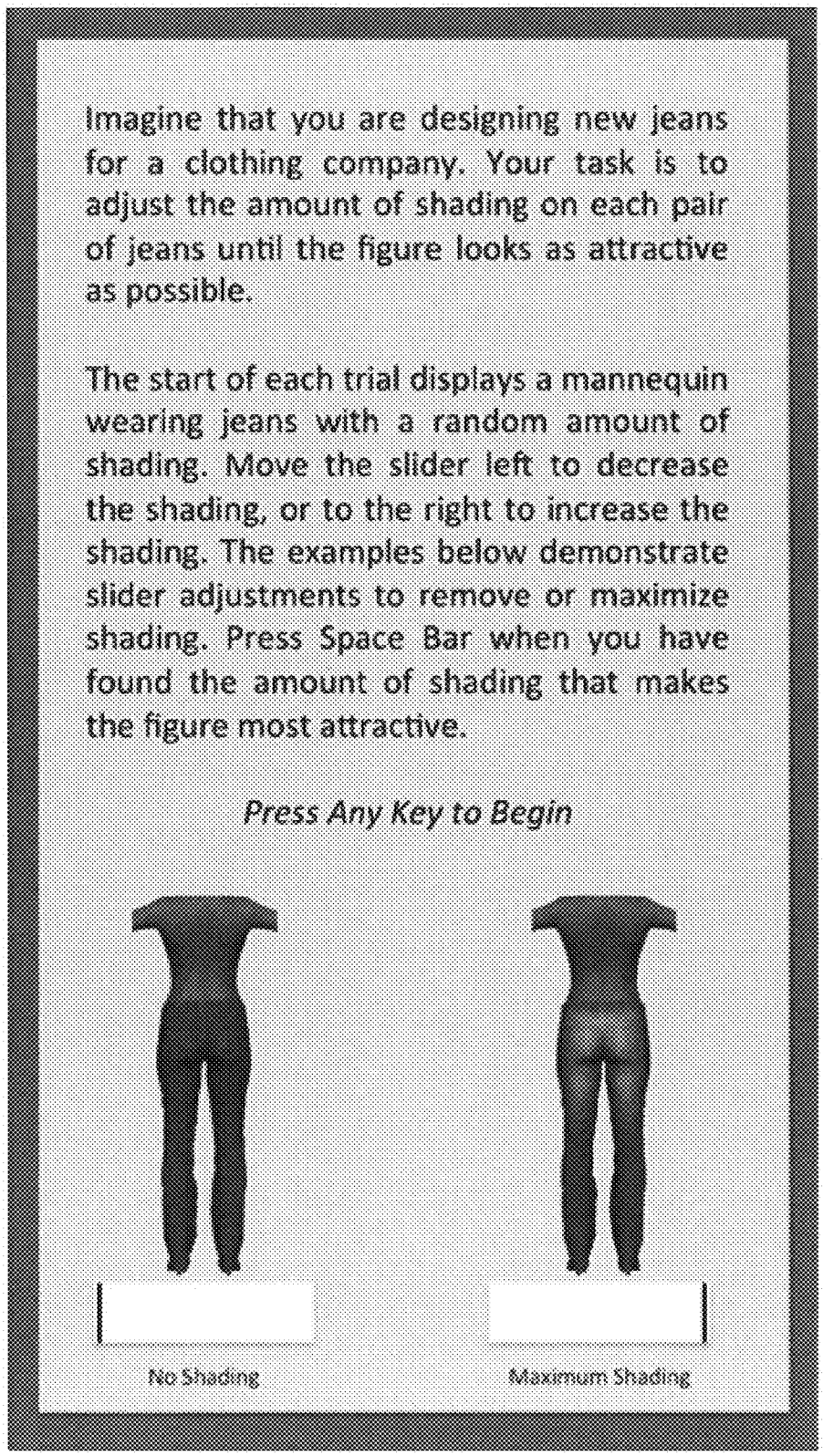

FIG. 10 shows instructions that were provided to subjects in an experiment to evaluate anatomy patterns formed on jeans.

Figure 11:
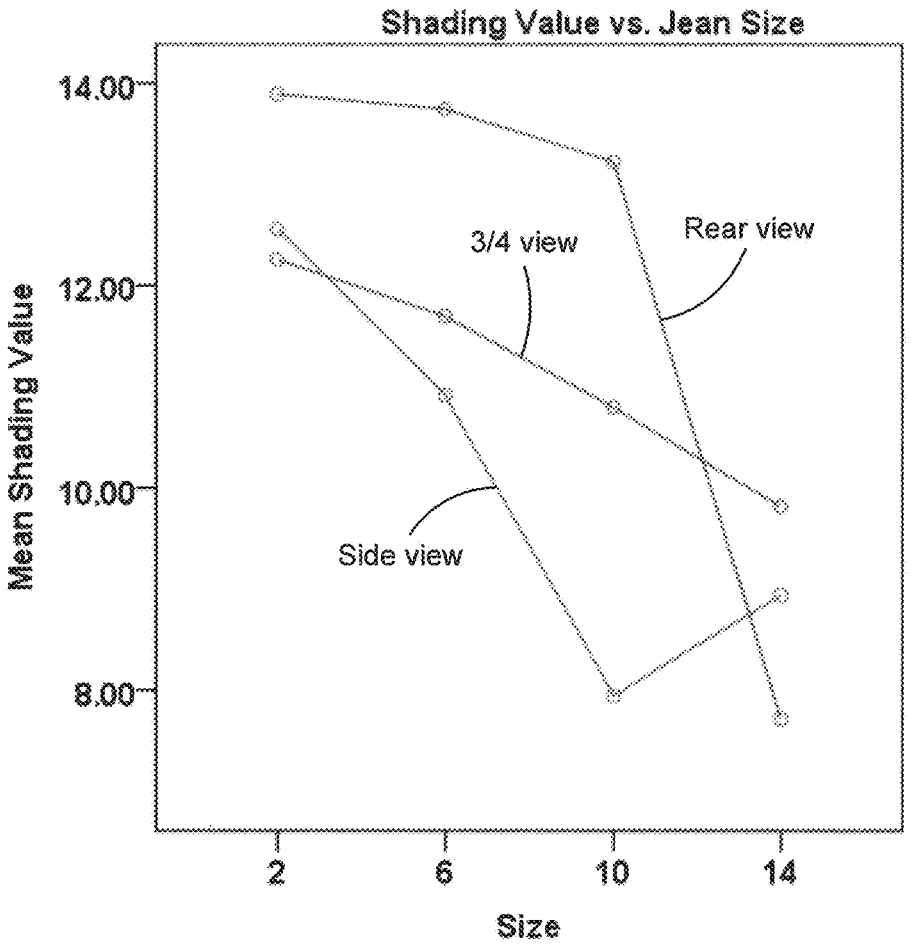

FIG. 11 is a graph of the results of the experiment described in FIG. 10.

Figure 12:
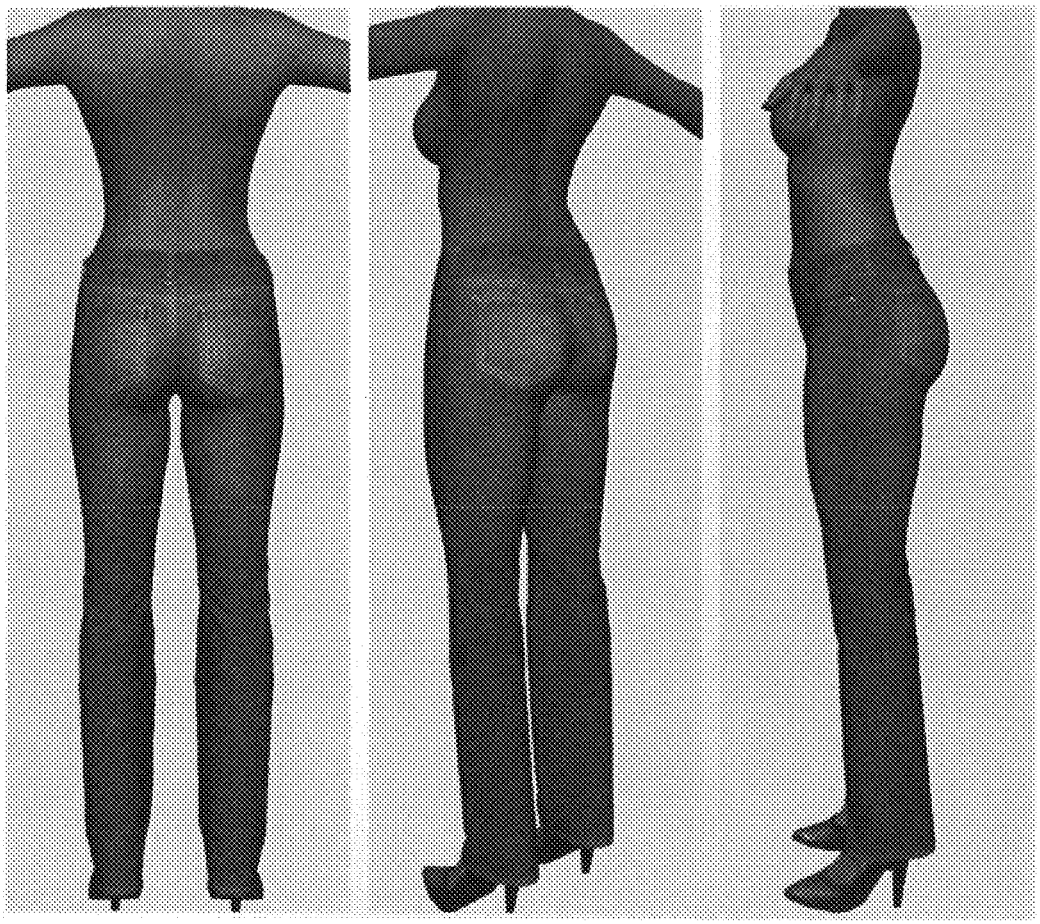

FIG. 12 is a rendering of an optimal anatomy-shading finish for size 2 jeans.

Figure 13:
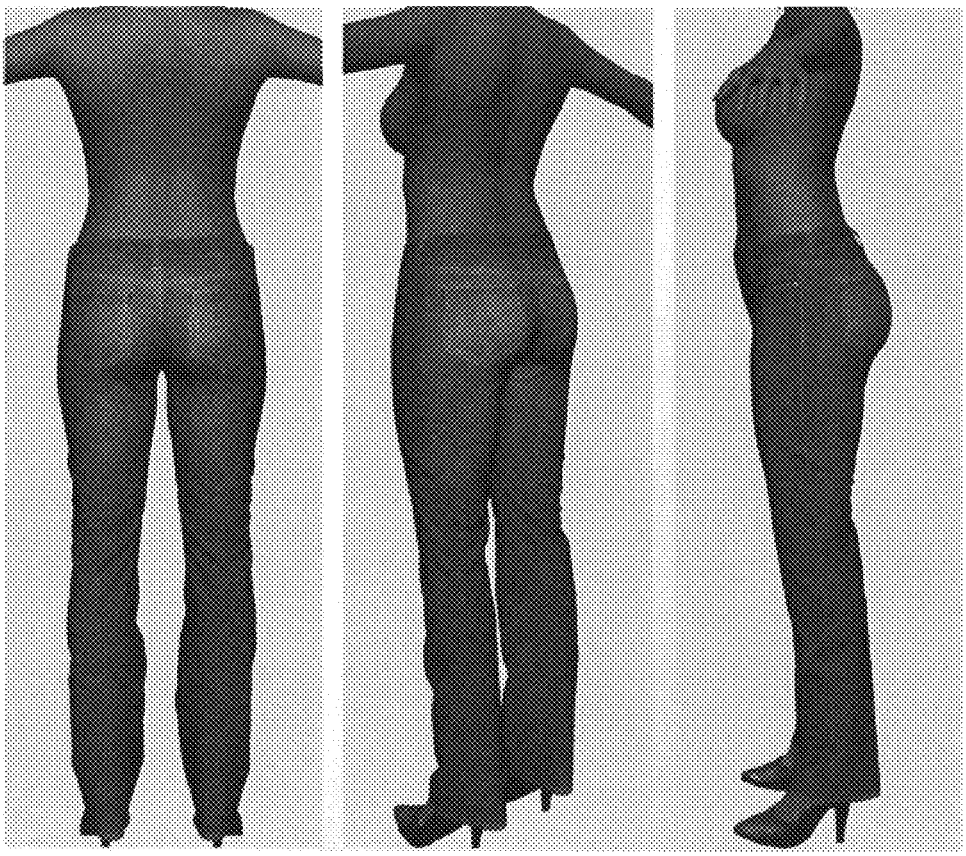

FIG. 13 is a rendering of an optimal anatomy-shading finish for size 6 jeans.

Figure 14:
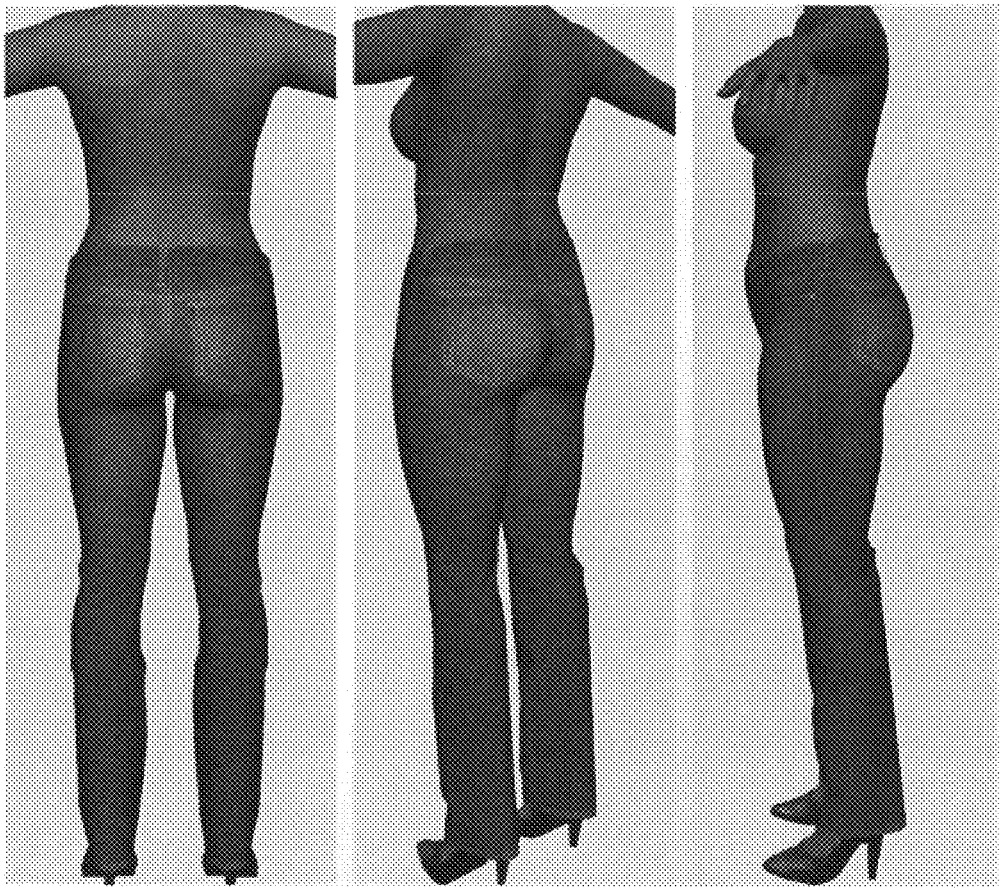

FIG. 14 is a rendering of an optimal anatomy-shading finish for size 10 jeans.

Figure 15:
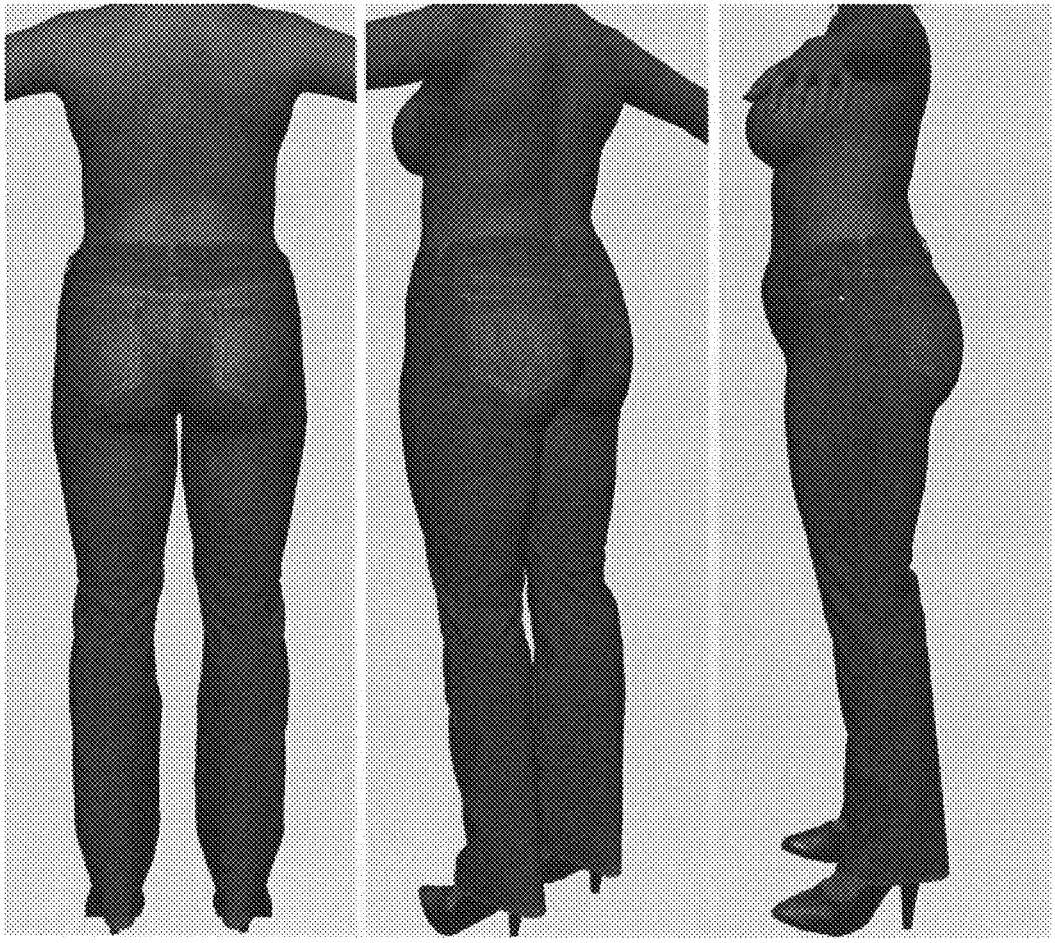

FIG. 15 is a rendering of an optimal anatomy-shading finish for size 14 jeans.

Figure 16:
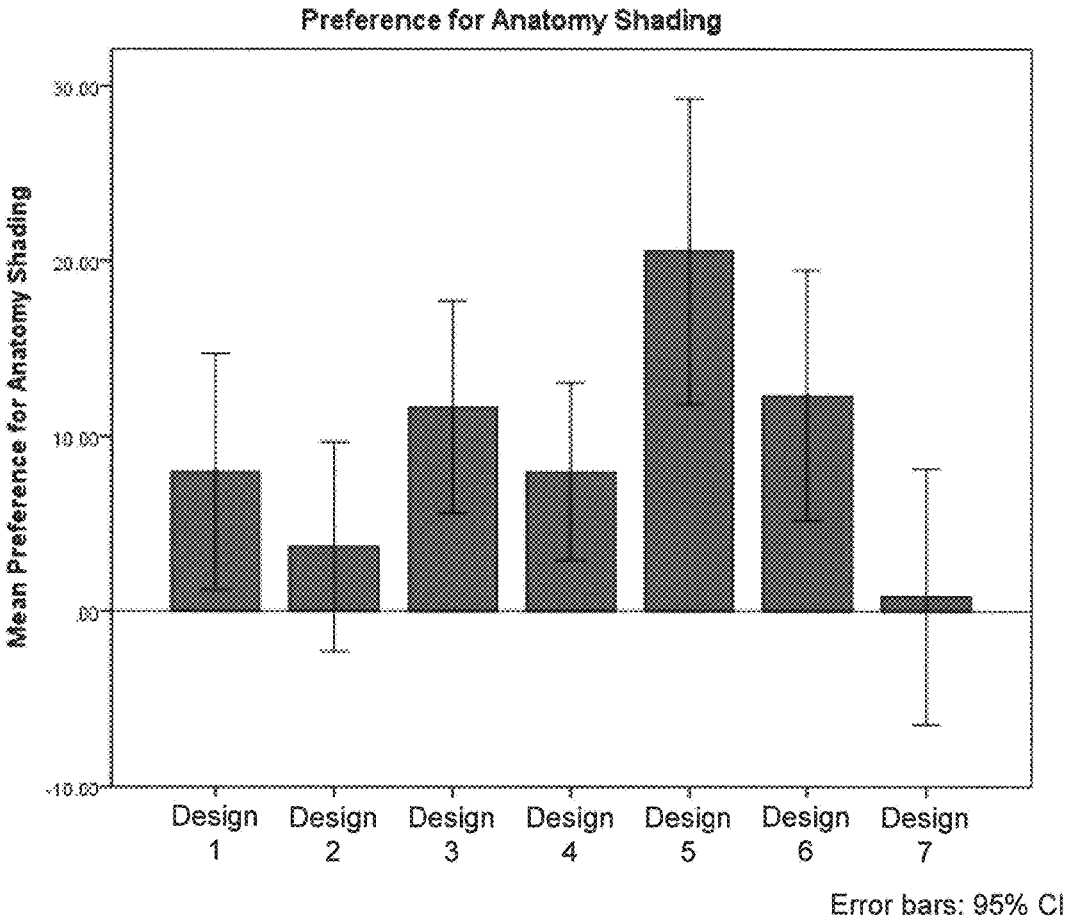

FIG. 16 is a graph that shows the preference for anatomy-shading finishes versus standard finishes.

Figure 17:
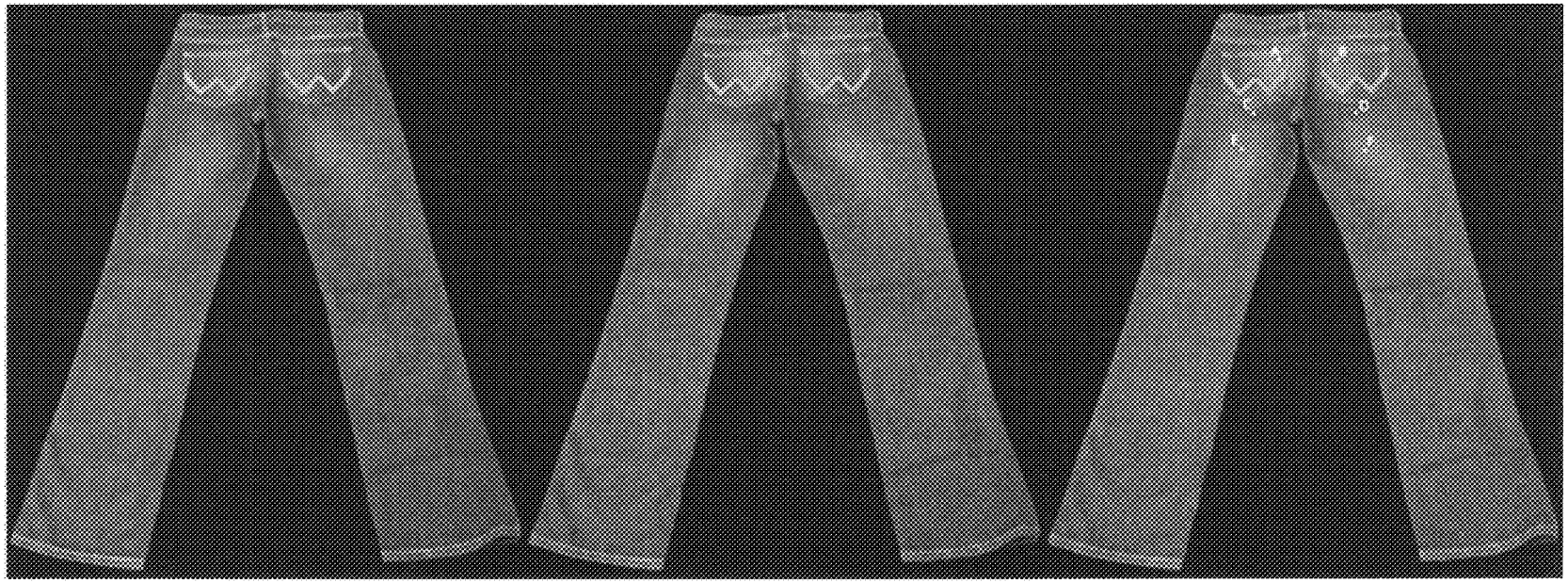

FIG. 17 is a digital photograph of the back side of a pair of size 6 women's jeans that have been anatomy shaded using a laser process. The same jeans are depicted three times: first in color, second in grayscale, and third in grayscale with reference letters.

Figure 18:
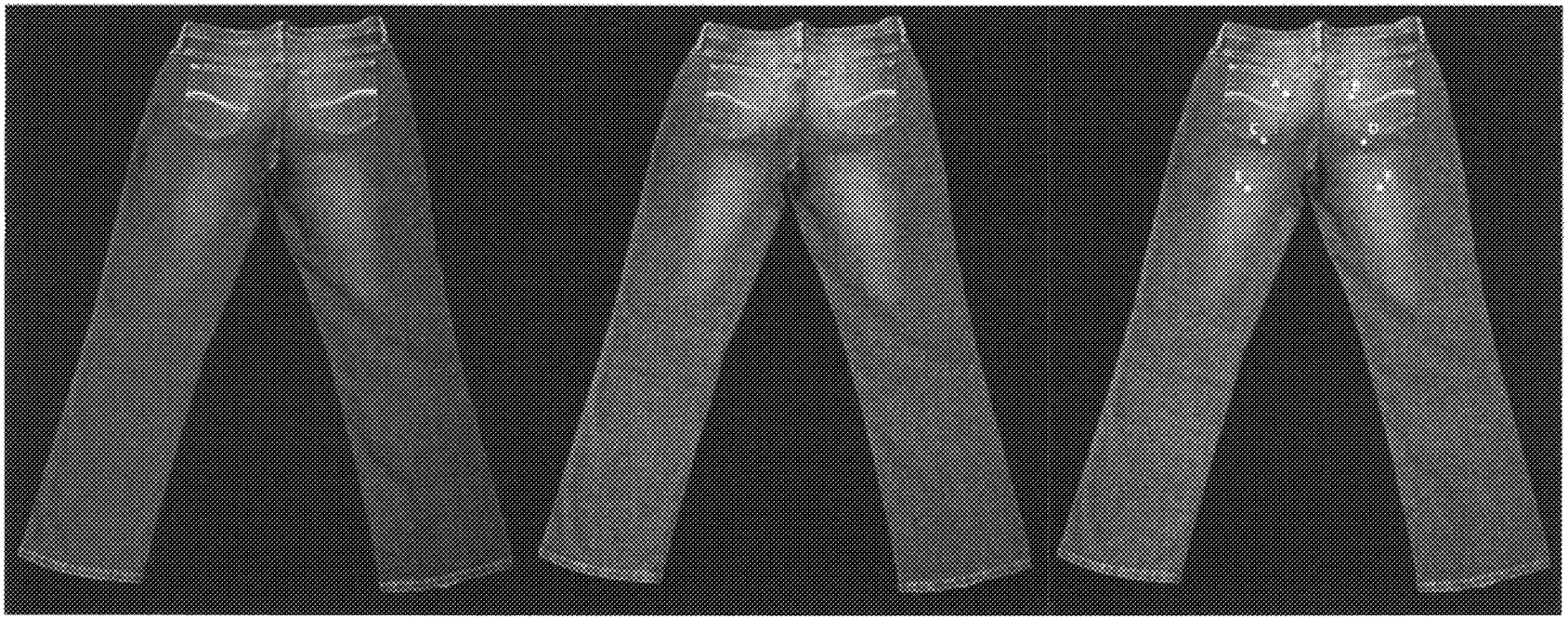

FIG. 18 is a digital photograph of the back side of a pair of size 14 women's jeans that have been anatomy shaded using a laser process. The same jeans are depicted three times: first in color, second in grayscale, and third in grayscale with reference letters.

Figure 19:
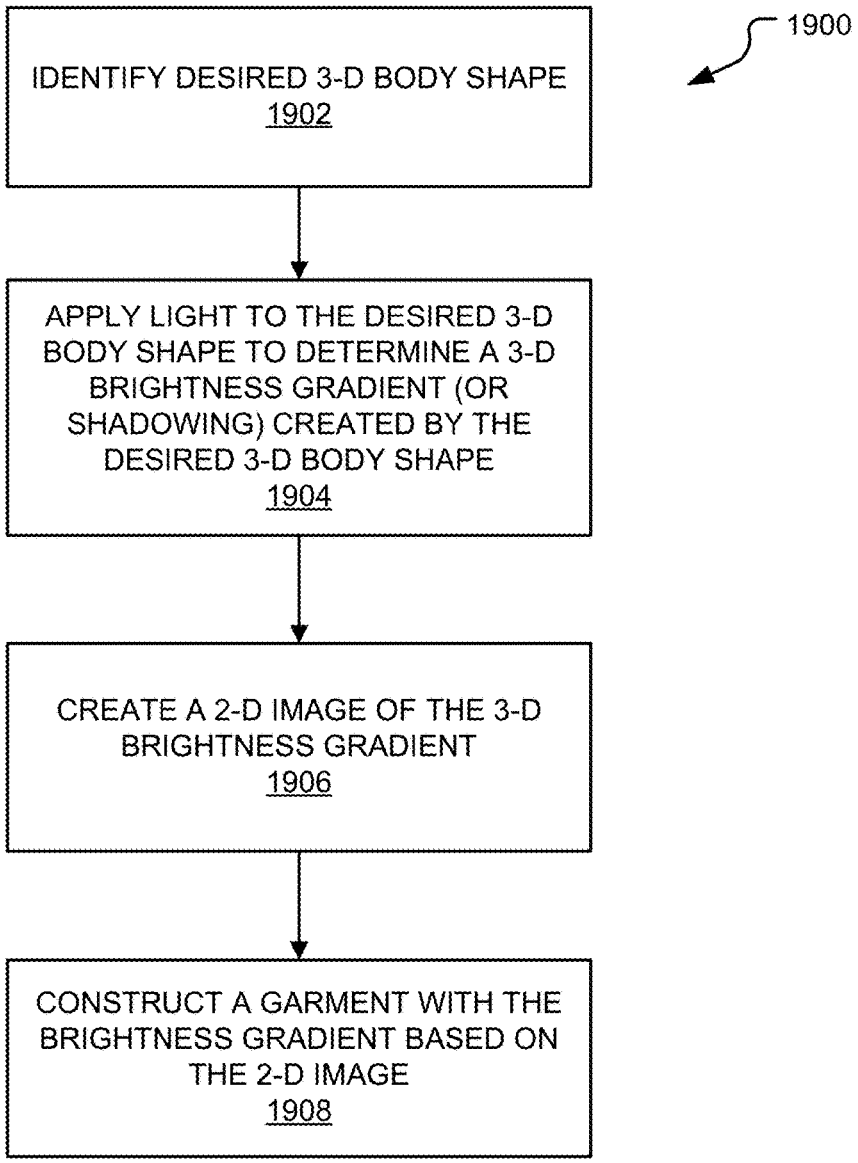

FIG. 19 is a flow diagram illustrating a method for designing an anatomy shaded garment or a body-enhancing garment, in accordance with an aspect of the disclosure.

Figure 20:
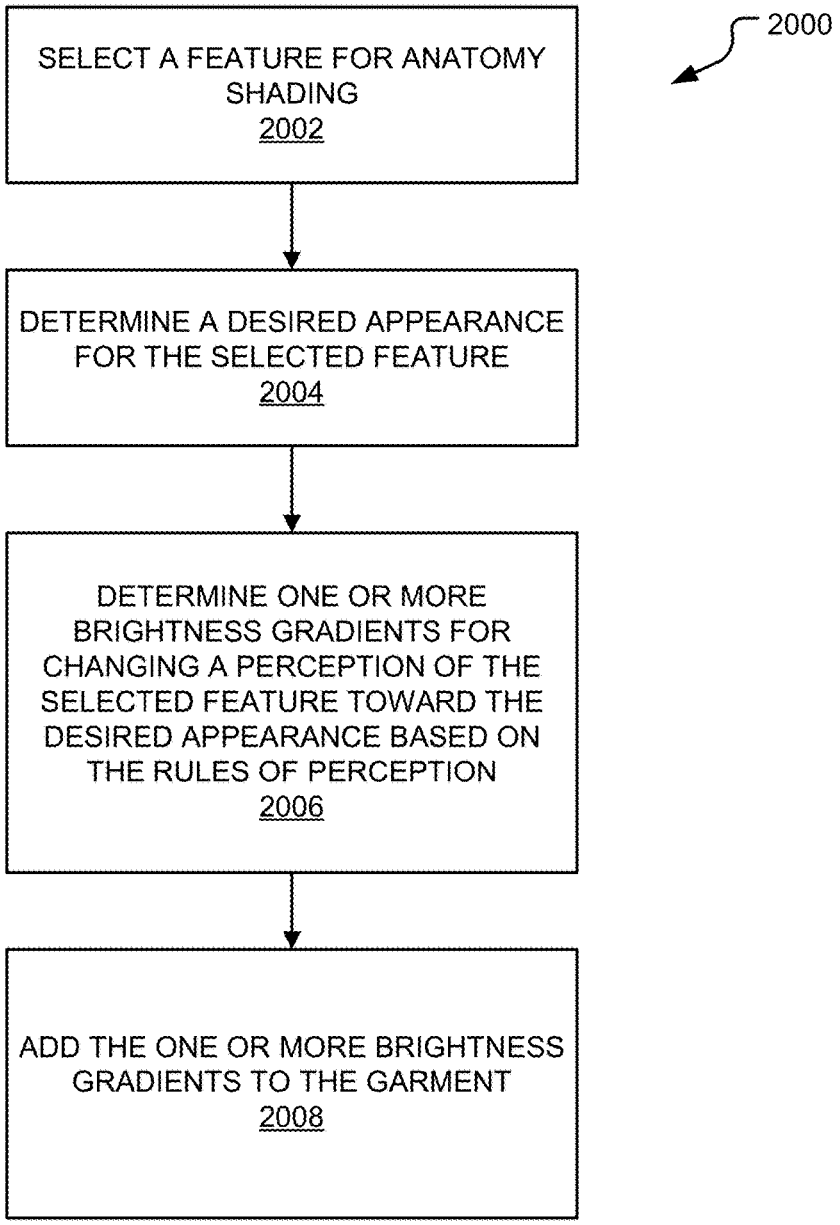

FIG. 20 is a flow diagram illustrating a method for designing an anatomy shaded garment or a body-enhancing garment, in accordance with an aspect of the disclosure.

DETAILED DESCRIPTION

As described above, it would be desirable to form patterns on garments that do not reduce the attractiveness of the wearer and, more preferably, increase the physical attractiveness of the wearer. Disclosed herein are systems and methods for achieving these goals, as well as garments that result from use of the systems and methods. Generally speaking, the garments include a shading that forms a brightness gradient across the surface of the garment that emulates the contours of an ideally proportioned body. Because the brightness gradient is based upon ideal proportions of the human form and because the brain interprets the gradients as three-dimensional shapes, the gradients create a three-dimensional interpretation of a maximally attractive form, thereby increasing the attractiveness of the garment wearer. In some embodiments, the brightness gradients are generated by creating ideally attractive three-dimensional models of the human form for each of multiple garment sizes and illuminating the models to generate brightness gradients that can be used to create two-dimensional templates, which can be used to form the patterns on the garments. Because the patterns are based on the anatomy of an ideally proportioned body, the patterns can be referred to as "anatomy shading."

In the following disclosure, various specific embodiments are described. It is to be understood that those embodiments are example implementations of the disclosed inventions and that alternative embodiments are possible. All such embodiments are intended to fall within the scope of this disclosure.

It is known from the field of vision science that brightness gradients are automatically interpreted by the human visual system in terms of three-dimensional shapes. Therefore, brightness gradient patterns on garments, such as jean finishes, trigger the visual system to automatically engage in creating a three-dimensional shape. The human vision further automatically evaluates human shapes for attractiveness. It is known from the field of evolutionary psychology that each time an individual encounters a person; the individual's brain automatically evaluates a multitude of sensory cues relating to the health and reproductive fitness of the person within a fraction of a second. The individual's initial judgment on attractiveness is a summary of that evaluation, with greater attractiveness being felt toward individuals who appear healthier and more reproductively fit. Therefore, the three-dimensional shape of a person's body is a critical sensory cue that is used to assess the attractiveness of the person.

In view of these insights, it has been determined that clothing shading patterns can be utilized to capitalize upon the natural operation of the human vision system and brain. In particular, brightness gradient patterns can be provided on garments that trick the visual system into visualizing attractive three-dimensional shapes. Described below are garment patterns that can be used to increase the perceived attractiveness of the garment wearer. More particularly, described below are jeans "finishes" for the posterior of women's jeans that increase the attractiveness of the wearer's buttocks and upper thighs. While this specific application is discussed in detail, it is noted that the same principles can be applied to create shading patterns for substantially any body part and substantially any garment. Additionally, while use of the shading patterns is discussed for achieving a more attractive body shape, the shading patterns may be utilized for creating the perception of any desired body shape whether attractive or not.

The literature in the plastic surgery field has identified several properties of the three-dimensional shape of the female buttocks and upper thighs that are considered to be highly attractive. FIG. 1 is a schematic diagram of a female buttock and thigh in side view that identifies various distances that can be used to gauge attractiveness. In this figure, point A identifies the location of the greater trochanter, point B identifies the point of maximal projection of the mans veneris, point C identifies the point of maximal gluteal projection, and point D identifies the location of the anterior superior iliac spine.

FIG. 2 is a photograph of ideally proportioned female buttocks and thighs in rear view and identifies various areas that have an impact upon attractiveness. Area 1 is the lateral depression formed by the lateral border of the gluteus maximus, the quadratus femoris, and the insertions of the gluteus medius and vastus lateralis to the greater trochanter (hereinafter the "lateral gluteal depression"). Area 2 is the infragluteal fold created by the ischial tuberosity, the insertions of the semitendinous muscle and long belly of the biceps femoris, and the lower border of the gluteus maximus (hereinafter the "infragluteal fold"). Area 3 is the supragluteal fossette positioned over the posterior superior iliac spine and created by the multifidus muscle, the lumbodorsal aponeurosis, and the insertion of the gluteus maximus (hereinafter the "supragluteal fossette"). Area 4 is the V-shaped crease arising in the proximal portion of the gluteal crease (hereinafter the "V-shaped crease"). According to Cuenca-Guerra & Quezada in "What Makes Buttocks Beautiful? A Review and Classification of the Determinants of Gluteal Beauty and the Surgical Techniques to Achieve Them" (Aesthetic Plastic Surgery, 2004 September-October; 28(5): 340-7.2004), which is hereby incorporated by reference into the present disclosure, ideally attractive buttocks/thighs are those that satisfy the following criteria:

1. The distance between points A and C (FIG. 1) should be twice as large as the distance between points A and B;
2. The infragluteal fold (Area 2; FIG. 2) should not extend beyond two-thirds the width of the thigh;
3. The lower spine (FIG. 1) should be angled out five to seven degrees from vertical; and
4. The V-shaped crease (Area 4; FIG. 2) should be about the size shown in the photograph.

If a template can be created that gives the observer the impression of the shapes that result from some or all of these criteria, the attractiveness of a wearer of a pair of jeans having a finish based upon the template can be increased.

Templates of the type described above can be created in a variety of ways. In some embodiments, templates can be created based upon three-dimensional computer models, or avatars, of ideal human forms. More particularly, an ideal avatar can be created for each of multiple body (e.g., pant) sizes for the purpose of creating a template for each size. FIG. 3 shows an example size 2 avatar in three-quarters, side, and rear view that was created with a software program called V-Stitcher™. The avatar shown in this figure was created so as to satisfy each of Criteria 1-4 identified above.

Therefore, the avatar can be considered to be an ideal size 2 avatar in terms of physical attractiveness. FIG. 4 shows further avatars for sizes 6, 10, and 14 (from left to right) in rear view. Again, each avatar satisfies Criteria 1-4 and, therefore, each is an ideal avatar for its particular size.

As indicated in FIGS. 3 and 4, each avatar has been virtually illuminated so as to cast shadows on the avatars that reveal the contours of the avatars' shapes. In some embodiments, the illumination is an ideal illumination that both emulates natural lighting and best reveals the avatar's contours. This lighting therefore creates a three-dimensional brightness gradient across the surface of each avatar that accentuates the contours of the avatar.

Once these brightness gradients have been generated, they can be used to create templates for patterns that can be applied to garments. This process is schematically illustrated in FIG. 5. The image in the left panel of FIG. 5 shows a simulation of a size 10 pair of jeans prior to applying a pattern. The jeans therefore have a uniform blue color and show minimal brightness gradients on the body. The image in the right panel of the figure shows a simulation of the jeans after the application of a pattern that was based upon a two-dimensional template, which is shown in the center panel. In this example, the template was created by capturing a two-dimensional snapshot of the three-dimensional ideal size 6 avatar from the rear perspective (see left image in FIG. 4). The pattern can be formed on the jeans in a variety of ways. In some embodiments, the pattern can be formed by manually or automatically abrading the garment (denim) substrate to create relatively light areas. In other embodiments, the relatively light areas can be formed by using a laser process.

As can be appreciated from the image in the right panel of FIG. 5, the jeans have been lightened in areas that are brightest in the template to emulate the three-dimensional shape of an ideal body. Accordingly, the jeans have "anatomy shading" that simulates the lighting that falls on an ideally proportioned three-dimensional body. The pattern/shading forms a brightness gradient that tricks the visual system into seeing the ideal three-dimensional shape. Because the brightness gradient emulates from the ideal avatar, which is based upon the ideal body shape, the gradient reflects at least some of the criteria for ideal buttocks and thighs described above. Generally speaking, the brightness gradient pattern has relatively bright spots associated with high points of the contours of ideally proportioned buttocks and relatively dark spots associated with low points of the contours of the ideally proportioned buttocks. As can be appreciated from a comparison between FIGS. 2 and 5, the brightness gradient is relatively bright in the areas associated with the central region of each buttock. In addition, the gradient is relatively dark in the areas associated with the infragluteal folds of the ideally proportioned body (Area 2) and the medial V-shaped crease (Area 4) of the ideally portioned body, which directly correspond with Criteria 2 and 4 identified above. Notably, this is in direct contrast with conventional jeans finishes, which often are lightened in the areas of the infragluteal fold and/or the medial V-shaped crease.

The brightness gradient can further be described in terms of the perspective of the observer. This is illustrated in FIG. 6, which schematically shows a buttock 10 of a jeans wearer and the eye 12 of an orthographic observer. In this figure, the surface normal, n, points toward the observer, who observes the buttock 10 along the direction of a unit vector $\hat{v}$. The brightness of the gradient on the jeans is maximal at the normal point and decreases as the angle θ away from the normal increases. More particularly, the brightness of the gradient is a function of the cosine of θ, which is greatest (i.e., 1) in the normal direction (i.e., θ=0°) and smallest (i.e., 0) in the perpendicular direction (i.e., θ=90°). Stated otherwise, the brightness of the pattern is proportional to $n \cdot \hat{v}$.

Although only the rear view of the avatar was used to form the pattern shown in FIG. 5, it is noted that alternative views (e.g., three-quarter view or side view) of the avatar can be used to create a template and pattern. In such cases, other criteria of ideally attractive buttocks/thighs may be taken into greater account. Moreover, it is noted that two or more avatar views can be combined to form a hybrid brightness gradient template and pattern.

The brightness gradients can be further mathematically defined using a set of control points C(x, y, z) in $R^3$ given by a discrete function of the form C(x, y, z)=(x, y, b(x, y)). FIG. 7 provides graphical representations of four sets of control points that are the basis for brightness gradients for the rear view of apparent in sizes 14, 10, 6, and 2 (from left to right). The control points are not shown numerically, but instead are represented by individual pixels in the graphical representations. In these graphical representations, the function b(x, y) is rendered as the brightness of pixels in three-dimensional space. Numerical values of the control points are available, but for each graphical representation, these numerical values comprise an array of, for example, 860×2,423=2,083,780 numbers. As will be recognized, the figure represents a large array of control points which can be readily determined by using known techniques to digitize the graphical representation.

Given the control points C(x, y, z)=(x, y, b(x, y)), a corresponding brightness gradient is any subset of any discretization of any continuous function A((x, y, a(x, y)) satisfying $\nabla\alpha=\nabla\lambda S(b(x,y))$ where S is a surface spline of order 3 or greater, $\lambda \in R^+$ is a global scale factor, and $$\overline{V} = \left(\frac{\partial}{\partial x}, \frac{\partial}{\partial y}\right)$$

is the gradient. These mathematics indicate that one can obtain a brightness gradient from a set of control points C(x, y, z) by using a polynomial function, such as a spline curve. For example, the brightness gradient can be obtained by: (1) creating a surface spline from the control points, (2) scaling the surface spline, (3) computing the slope at each control point, (4) interpolating a surface that matches the slope at each control point, (5) discretizing this surface, (6) adding to each point Gaussian noise of zero mean and standard deviation less than 10% of the standard deviation of the entire surface, and (7) selecting the subset of the discretized surface that corresponds appropriate to the location on the garment. Step (6) allows for small variations in anatomy finishes due to effects such as laser noise and the microstructure of the fabric of the garment.

FIG. 8 provides a graphical representation of sets of control points that can be used as the basis for providing a brightness gradient to the three-quarter view of apparel for sizes 14, 10, 6, and 2 (from left to right). FIG. 9 provides a graphical representation of sets of control points that can be used as the basis for a brightness gradient to the side view of apparel for sizes 14, 10, 6, and 2 (from left to right). All control points in these examples are available as arrays of 860 x 2,423 numbers, which were used to generate the graphical representations.

Once a brightness gradient has been created, one still must determine the magnitude that the gradient will have when it is applied to a garment as anatomy shading and, therefore, how obvious the gradient will be. A psychophysical experiment was designed to determine the optimal magnitude of the brightness gradient when provided on jeans. In the experiment, participants were given the freedom to adjust how bright the gradient appeared, from invisible to highly visible. The participants could not, however, modify the brightness gradient (i.e., relative brightness), which was fixed. Participants were instructed to adjust the amount of "shading" until the human figure looked maximally attractive. FIG. 10 shows the full instructions displayed before the experiment. Participants made adjustments on jeans observed from the rear view, the three-quarters view, and the side view.

The results of this experiment are shown in the graph of FIG. 11. This graph identifies the optimal visibility for the brightness gradient for size 2, 6, 10, and 14, jeans and for each direction of view (rear, three-quarters, side). The x axis of the graph corresponds to the jean size while the y axis corresponds to the mean shading value, which is a measure of the overall contrast in the anatomy shading region, which extended from the waist to the knees. The mean shading value therefore provides an indication of how noticeable the anatomy shading is. A value of "0" corresponds to no contrast (i.e., the region is completely dark) while a value of "100" corresponds to maximal contrast with the background jean (i.e., the region is completely white). As can be appreciated from FIG. 11, the optimal magnitude of the brightness gradient varies between sizes and views. One general trend, however, is that smaller sizes benefit from more visible brightness gradients while larger sizes benefit from less visible brightness gradients. For example, the ideal mean shading value for a size 2 pair of jeans is about 14, while the ideal mean shading value for a size 14 pair of jeans is about 8. The optimal anatomy shading that was determined through the experimentation for sizes 2, 6, 10, and 14 is illustrated in FIGS. 12-15, respectively. As can be appreciated from these figures, the anatomy shading provided on each pair of jeans is similar to that shown in the image of the right panel of FIG. 5, irrespective of the magnitude. Therefore, in each case, the high points of the buttocks are relatively light while infragluteal fold and V-shaped crease areas are relatively dark.

As an alternative and non-limiting embodiment, anatomy shaded pants according to the present invention (including but not limited to jeans) may comprise, either singly or in any combination, (a) relatively bright spots associated with the central region of each buttock, (b) relatively dark spots associated with the infragluteal folds, and (c) relatively bright spots associated with the upper rear thighs of the ideally proportioned body.

It will be appreciated that the location and size of the relatively bright and dark spots may vary depending on the size of the pant or jean. In some embodiments, the brightness gradient applied to a garment decreases in intensity or is made less bright as the garment increases in size. As such, in these embodiments, the brightness gradient applied to a garment increases in intensity or is made brighter as the garment decreases in size. For example, a size 2 garment will have a brighter brightness gradient than a size 4, a size 4 garment will have a brighter brightness gradient than a size 6, and a size 10 garment will have a darker or less bright brightness gradient than a size 8. While the brightness gradient is adjusted before application based on size in these embodiments, when the garments are laid flat the brain will perceive the garments as having the same brightness gradients even though they are different. In some aspects, the brightness gradient may decrease in brightness by 1%, 2%, 3%, 4% or 5% for each increase in size of a garment. These percentages are exemplary only are not meant to be limiting.

In some embodiments, the relatively bright spots associated with the central region of each buttock may have center points that are generally vertically located between 4.5 and 7.5 inches above the crotch level, and generally horizontally located between 1.5 and 4.5 inches from the center seam; alternatively vertically located between 5 and 7 inches above the crotch level, and horizontally located between 2 and 4 inches from the center seam; alternatively vertically located between 5.5 and 7 inches above the crotch level, and horizontally located between 2.2 and 3.5 inches from the center seam; alternatively vertically located between 5.7 and 6.7 inches above the crotch level, and horizontally located between 2.5 and 3 inches from the center seam. For example, for size 6 jeans, the relatively bright spots associated with the central region of each buttock may have center points that are generally vertically located between 4.5 and 7.5 inches above the crotch level, and generally horizontally located between 1.5 and 4.5 inches from the center seam; alternatively vertically located between 5 and 7 inches above the crotch level, and horizontally located between 2 and 4 inches from the center seam; alternatively vertically located between 5.5 and 6.5 inches above the crotch level, and horizontally located between 2.3 and 3.2 inches from the center seam; alternatively vertically located between 5.7 and 6.1 inches above the crotch level, and horizontally located between 2.5 and 3 inches from the center seam. And for example, for size 14 jeans, the relatively bright spots associated with the central region of each buttock may have center points that are generally vertically located between 5.5 and 7.5 inches above the crotch level, and generally horizontally located between 1.5 and 4.5 inches from the center seam; alternatively vertically located between 6 and 7 inches above the crotch level, and horizontally located between 2 and 4 inches from the center seam; alternatively vertically located between 6.2 and 6.8 inches above the crotch level, and horizontally located between 2.2 and 3.5 inches from the center seam; alternatively vertically located between 6.5 and 6.8 inches above the crotch level, and horizontally located between 2.7 and 2.9 inches from the center seam. Generally, the brightness gradient decreases outwardly from the center point (or region surrounding the center point) until the brightness level matches that of the garment before the finish was applied. The shape of each bright spot may vary but may be spherical, oval or aspherical. The bright spots will have a variable area depending on the gradient level. Alternatively, each bright spot may have an area of between 20 and 40 square inches, alternatively between 25 and 35 square inches.

In some embodiments, the relatively dark spots associated with the infragluteal folds may have center points that are generally vertically located between 0.5 inches below and 4 inches above the crotch level, and generally horizontally located between 3 and 6.5 inches from the center seam; alternatively vertically located between 0 and 3 inches above the crotch level, and horizontally located between 3.5 and 6 inches from the center seam; alternatively vertically located between 1 and 2.5 inches above the crotch level, and horizontally located between 4 and 5.5 inches from the center seam; alternatively vertically located between 1.3 and 2.3 inches above the crotch level, and horizontally located between 4 and 5 inches from the center seam. For example, for size 6 jeans, the relatively dark spots associated with the infragluteal folds may have center points that are generally vertically located between 0.5 inches below and 2.5 inches above the crotch level, and generally horizontally located between 3.5 and 6.5 inches from the center seam; alternatively vertically located between 0 and 2 inches above the crotch level, and horizontally located between 4 and 6 inches from the center seam; alternatively vertically located between 0.5 and 1.5 inches above the crotch level, and horizontally located between 4.5 and 5.5 inches from the center seam; alternatively vertically located between 1 and 1.3 inches above the crotch level, and horizontally located between 4.7 and 5.5 inches from the center seam. And for example, for size 14 jeans, the relatively dark spots associated with the infragluteal folds may have center points that are generally vertically located between 1.5 and 4 inches above the crotch level, and generally horizontally located between 3 and 6 inches from the center seam; alternatively vertically located between 2 and 3.5 inches above the crotch level, and horizontally located between 3.5 and 5.5 inches from the center seam; alternatively vertically located between 2 and 3 inches above the crotch level, and horizontally located between 4 and 5 inches from the center seam; alternatively vertically located between 2.3 and 2.7 inches above the crotch level, and horizontally located between 4.2 and 4.7 inches from the center seam. Generally, the brightness gradient increases outwardly from the center point (or region surrounding or contiguous with the center point) until the brightness level matches that of the garment before the finish was applied. The shape of each dark spot may vary but may generally be an irregular elongated oval or curving projection that extends outwards from the crotch. The dark spots will have a variable area depending on the gradient level. Alternatively, each dark spot may have an area of between 4 and 20 square inches, alternatively between 5 and 15 square inches, alternatively between 6 and 12 square inches.

In some embodiments, the relatively bright spots associated with the upper rear thighs may have center points that are generally vertically located between 1.5 and 4.5 inches below the crotch level, and generally horizontally located between 5 and 8 inches from the inner seam of the leg; alternatively vertically located between 2 and 4 inches below the crotch level, and horizontally located between 5.5 and 7.5 inches from the inner seam of the leg; alternatively vertically located between 2 and 3 inches below the crotch level, and horizontally located between 6 and 7 inches from the inner seam of the leg; alternatively vertically located between 2.5 and 3 inches below the crotch level, and horizontally located between 6 and 6.8 inches from the inner seam of the leg. For example, for size 6 jeans, the relatively bright spots associated with the upper rear thighs may have center points that are generally vertically located between 1.5 and 3.5 inches below the crotch level, and generally horizontally located between 5 and 7.5 inches from the inner seam of the leg; alternatively vertically located between 2 and 3 inches below the crotch level, and horizontally located between 5.5 and 7 inches from the inner seam of the leg; alternatively vertically located between 2.2 and 2.8 inches below the crotch level, and horizontally located between 5.8 and 6.7 inches from the inner seam of the leg; alternatively vertically located between 2.3 and 2.7 inches below the crotch level, and horizontally located between 6 and 6.5 inches from the inner seam of the leg. And for example, for size 14 jeans, the relatively bright spots associated with the upper rear thighs may have center points that are generally vertically located between 1.5 and 4.5 inches below the crotch level, and generally horizontally located between 5 and 8 inches from the inner seam of the leg; alternatively vertically located between 2 and 4 inches below the crotch level, and horizontally located between 5.5 and 7.3 inches from the inner seam of the leg; alternatively vertically located between 2.5 and 3.5 inches below the crotch level, and horizontally located between 6 and 7 inches from the inner seam of the leg; alternatively vertically located between 2.8 and 3.2 inches below the crotch level, and horizontally located between 6.3 and 6.9 inches from the inner seam of the leg. Generally, the brightness gradient decreases outwardly from the center point (or region surrounding the center point) until the brightness level matches that of the garment before the finish was applied. The shape of each bright spot may vary but may generally be an elongated regular or irregular (or partial regular or irregular) oval. The bright spots will have a variable area depending on the gradient level. Alternatively, each bright spot may have an area of between 20 and 80 square inches, alternatively between 20 and 50 square inches, alternatively between 25 and 40 square inches. The magnitude of the brightness of the bright spots and the degree of contrast between the bright spots and the dark spots may vary. The magnitude of the brightness of bright spots on jeans and other garments can be measured through use of a spectroradiometer. By way of non-limiting example, the peak magnitude of the brightness of the bright spots on the garments described herein, as measured by spectroradiometer under normal indoor fluorescent lighting, may range anywhere from 2.5 to 6 cd/m2 , alternatively 2.8 to 5 cd/m2 , alternatively 3 to 4 cd/m2.

FIG. 17 is a digital photograph of the back side of a pair of size 6 women's jeans that have been anatomy shaded using a laser process in accordance with the present invention. The digital image was analyzed to determine the location of the relatively bright spots associated with the central region of each buttock (points A and B in FIG. 17), the location of the relatively dark spots associated with the infragluteal folds (points C and D in FIG. 17), and the location of the relatively bright spots associated with the upper rear thighs (points E and F in FIG. 17). Table 1 lists values that were obtained from digital analysis of the photograph, as well as spectroradiometer readings that were taken on the jeans themselves. The first row lists the (x, y) coordinates of each point on the image. The second row list the digital brightness value for each point, where a value of zero is black and a value of 1 is maximum brightness. The third row lists the approximate horizontal distance of each point from the left edge of the center seam (from the inseam for the upper rear thighs) in inches. The fourth row lists the approximate vertical distance of each point from the crotch level (the top of the inseam of the jeans) in inches. The fifth row lists the luminance of each point in cd/m2, as measured under normal indoor fluorescent lighting with a SpectraScan® PR670 by Photo Research.

TABLE 1

| | A | B | C | D | E | F |
|---|---|---|---|---|---|---|
| (X, Y) Coordinate | (1667, 390) | (2062, 395) | (1484, 772) | (2204, 767) | (1397, 1028) | (2271, 1034) |
| Brightness Value (0-1) | 0.4549 | 0.4549 | 0.2902 | 0.27059 | 0.42745 | 0.43137 |

TABLE 1-continued

| | A | B | C | D | E | F |
|---|---|---|---|---|---|---|
| Approximate distance from center seam (in.) | 2.5 | 3 | 5 | 5 | 6 | 6.5 |
| Approximate distance from crotch level (in.) | 6 | 5.75 | 1 | 1.25 | −2.5 | −2.5 |
| Luminance (cd/mL) | 3.583 | 3.384 | 2.067 | 2.163 | 3.083 | 2.652 |

FIG. 18 is a digital photograph of the back side of a pair of size 14 women's jeans that have been anatomy shaded using a laser process in accordance with the present invention. The digital image was analyzed to determine the location of the relatively bright spots associated with the central region of each buttock (points A and B in FIG. 18), the location of the relatively dark spots associated with the infragluteal folds (points C and D in FIG. 18), and the location of the relatively bright spots associated with the upper rear thighs (points E and F in FIG. 18). Table 2 lists values that were obtained from digital analysis of the photograph, as well as spectroradiometer readings that were taken on the jeans themselves. The rows in the table contain the same information as described for Table 1.

TABLE 2

| | A | B | C | D | E | F |
|---|---|---|---|---|---|---|
| (X, Y) Coordinate | (1729, 637) | (2180, 667) | (1568, 962) | (2278, 975) | (1454, 1301) | (2386, 1299) |
| Brightness Value (0-1) | 0.61569 | 0.53333 | 0.23922 | 0.2549 | 0.47843 | 0.43922 |
| Approximate distance from center seam (in.) | 2.5 | 2.75 | 4.25 | 4.5 | 6.75 | 6.5 |
| Approximate distance from crotch level (in.) | 6.5 | 6.75 | 2.5 | 2.5 | −3 | −3 |
| Luminance (cd/mL) | 3.907 | 4.065 | 2.237 | 2.053 | 3.912 | 4.039 |

A further experiment was performed to test whether or not the subjects really do prefer the anatomy shading finish to conventional jean finishes. In each trial, a subject was shown a jean with a standard finish created by VF Corporation and the same jean with an anatomy shading finish. The subject's task was to use a slider to indicate which finish was more attractive and by how much. The data from this experiment, across seven different styles of jeans, are shown in FIG. 16. The bars above the horizontal axis indicate preference for anatomy shading. The y axis indicates preference in either direction from 0 to 100. As can be appreciated from FIG. 16, the preference for anatomy-shading finishes over conventional finishes was quite reliable.

Several different processes or methods may be utilized to anatomy shade garments. In some embodiments, anatomy shading may be performed by adjusting the shading on clothing based on rules of perception (such as the principles of the geodesic assumption) after visible inspection on live models. In other embodiments, anatomy shading is based on the shading differences between an actual body shape of a selected feature and a desired body shape for that selected feature. In other embodiments, a method 1600 for anatomy shading may be utilized as illustrated in FIG. 19.

FIG. 19 is a flow diagram illustrating a method 1900 for designing an anatomy-shaded garment or a body-enhancing garment, in accordance with an aspect of the disclosure. Anatomy shading uses the rules of perception to change a perceived size and/or shape of the anatomy of the wearer. In some embodiments, anatomy shading is used to increase the attractiveness of the wearer. For example, the body-enhancing garment may be a pair of pants, a shirt, a jacket, a pair of shorts, a skirt, a dress, a pair of leggings, a pair of capris, a bra, a piece of underwear, a piece of swim wear, a pair of shoes, and/or a pair of skorts. This list is exemplary only and is not meant to be limiting. As understood by a person of skill in the art, the garment may be any clothing item for a human.

The routine or method 1900 begins at operation 1902, where a desired 3-D body shape or one or more features of the body is identified. The feature may be any body part or area of the body that is covered by the garment. For example, the feature may be the buttocks, thighs, waist, chest, shoulders, bosom, legs, arms, and/or or the chest. This list is exemplary only and is not meant to be limiting. In some embodiments, the desired 3-D body shape is generated by one or more computing devices. As understood by a person of skill in the art, the feature may be any portion of a human body. In some embodiments, the desired 3-D body shape is an attractive body shape based on known attractive size and shape ranges. For example, FIGS. 3, 4, and 7-9 could be utilized as the desired 3-D body shape. In other embodiments, the desired 3-D body shape accentuates or minimizes the appearance of a specific feature of the body. For example, the desired body shape may be any desired range of sizes and/or shapes for one or more features.

After the 3-D body shape is identified during operation 1902, method 1900 moves to operation 1904. At operation 1904, light is applied to the desired 3-D body shape to determine the shadowing or brightness gradient (or shaded pattern) created by the desired 3-D body upon the application of light. In some embodiments, operation 1904 is performed by one or more computing devices. FIGS. 3 and 4 illustrate different examples of a performance of operation 1904. For example, as discussed above, FIGS. 3 and 4 illustrate avatars that have been virtually illuminated so as to cast shadows on the avatars that reveal the contours of the avatars' shapes. In some embodiments, the illumination is an ideal illumination that emulates natural lighting and/or reveals the 3-D body shape. This lighting creates a 3-D brightness gradient across the surface of a desired body.

Next, at operation 1906, a 2-D image of the 3-D brightness gradient is created. In some embodiments, operation 1906 is performed by one or more computing devices. The formed 2-D image provides a template for adding the brightness gradient to a garment that changes the perception of the identified feature towards the appearance of the desired 3-D body shape.

In some embodiments, a consumer may further adjust the determined brightness gradient formed during operation 1906. This input may come from an adjustment task where the consumer can adjust the amount of shading or brightness on a simulated garment. For example, the consumer may move a slider left or right, where left simulates less shading and right simulates more shading. Consumer preferences are then accumulated to inform the preferred amount of shading or brightness to apply to the garment during operation 1906.

At operation 1908, the brightness gradient based on the 2-D image and/or the consumer preferences are applied to a garment. In some embodiments, the determined brightness gradient is applied to a garment with a machine (such as a laser or digital printer) and/or in an automated assembly process. In other embodiments, the determined brightness gradient is manually added to the garment. In alternative embodiments, the determined brightness gradient is applied manually and via a machine to the garment.

In some embodiments, during operation 1908, the brightness gradient has to be adjusted or transformed before application to the garment. This adjustment ensures that the finished garment creates one or more 3-D brightness gradients when worn on the body that are consistent with the brightness gradients created by the illuminated desired 3-D body shape. As such, the 2-D image of the brightness gradient must be adjusted so that the brightness gradients are applied to the garment in the correct position, size, and intensity. In some embodiments, as discussed above, the brightness gradient may be adjusted based on the size of the garment at operation 1908. For example, the brightness of the determined brightness gradient may be decreased as the size of the garment increases. Alternatively, the brightness of the brightness gradient may be adjusted or increased as the size of the garment decreases.

Further, different dyes and/or inks, washes and/or finishes create different contrast ranges. As such, the brightness gradient may be adjusted or transformed based on a visible contrast range of each product, printing technique, finishing technique and/or dyes at operation 1908. For example, when working with indigo dyed garments such as jeans, denim shirts, denim jackets, or knits, the visible contrast range may be dependent on the dry process (laser or manual application) and/or a wet process (washing with enzyme, softener, bleach, pumice stone, potassium permanganate, and/or chlorine). In this example, depending on the visible contrast range, the 2-D image is calibrated to fall within that contrast range created by the wet and dry processes. In another example, when working with printing techniques such as digital, sublimation, screen, or wet printing, the brightness gradient may also need to be adjusted or calibrated to fall within that contrast range created by these printing techniques.

In further embodiments, the brightness gradient is adjusted after visual inspection of the garment with an applied brightness gradient while being worn by a model or mannequin. In these embodiments, the adjustments to the brightness gradient made after a visible inspection ensure that a finished garment is consistent with the brightness gradients created by the illuminated desired 3-D body shape when applied to the garment.

In some embodiments, a method 2000 for designing an anatomy-shaded garment is disclosed as illustrated in FIG. 20. For example, the body-enhancing garment may be a pair of pants, a shirt, a jacket, a pair of shorts, a skirt, a dress, a pair of leggings, a pair of capris, a bra, a piece of underwear, a piece of swim wear, a pair of shoes, and/or a pair of skorts.

The method 2000 includes: selecting a feature for anatomy shading at operation 2002; determining a desired appearance for the selected feature at operation 2004; determining one or more brightness gradients for changing a perception of the selected feature toward the desired appearance based on the rules of perception at operation 2006; and adding the one or more brightness gradients to the garment at operation 2008. Operation 2006 may include determining the positioning of the one or more brightness gradients on the garment. The feature may be one or more different body parts. In some embodiments, operation 2008 is performed, manually, by a machine, such as a laser or printer, and/or by an automated process. In some embodiments, the desired appearance is an attractive appearance.

In other embodiments, operation 2008 includes adjusting the one or more determined brightness gradients before application to the garment to ensure that the applied one or more brightness gradients emulates the determined one or more brightness gradients upon application to the garment and when the garment in worn. For example, the one or more brightness gradients may be adjusted so that the brightness gradients are applied to the garment in the correct position, size, and intensity. In some embodiments, as discussed above, the brightness gradient may be adjusted based on the size of the garment. For example, smaller sizes may receive a more intense or brighter brightness gradient than larger sizes. In other embodiments, the brightness gradient may be adjusted or calibrated based on the visible contrast range of a garment. In still further embodiment, the brightness gradient may be adjusted after visible inspection of the garment with an applied brightness gradient while being worn by a model or mannequin.

In some embodiments, the amount of shading, sizing, and/or positioning of the one or more brightness gradients is determined or adjusted based on consumer feedback during the determining of the one or more brightness gradients at operation 2006. For example, the darkness, positioning, and/or sizing of the one or more shading patterns may be determined by utilizing an adjustment task where consumers may adjust the amount of shading or brightness on a simulated garment. For example, the consumer may move a slider left or right, where left simulates less shading, increased sizing and/or location shifting and right simulates more shading, decreased sizing and/or location shifting. Consumer preferences are then accumulated to inform the preferred amount of shading (sizing and/or location) to apply to the one or more brightness gradients at operation 2006.

As noted above, anatomy shading comprising brightness gradients can be applied to areas other than just the buttocks and rear thighs of jeans. For example, anatomy shading can be provided to the calves and the fronts of the thighs of jeans to emulate ideal proportions of those areas of the body. It is further noted that, while the above discussion has focused on jeans, anatomy shading can be provided on other pants, as well as other garments, which may include underwear, shorts, and shirts. Moreover, while applications for women's garments have been discussed with particularity, it is noted that anatomy shading that emulates ideal male proportions can be provided to men's garments in a similar manner.

Those skilled in the art will recognize that the methods and systems of the present disclosure may be implemented in many manners and as such are not to be limited by the foregoing exemplary embodiments and examples. In other words, functional elements being performed by a single or multiple components, in various combinations of hardware and software or firmware, and individual functions, can be distributed among software applications at either the client or server level or both. In this regard, any number of the features of the different embodiments described herein may be combined into single or multiple embodiments, and alternate embodiments having fewer than or more than all of the features herein described are possible. Functionality may also be, in whole or in part, distributed among multiple components, in manners now known or to become known. Thus, myriad software/hardware/firmware combinations are possible in achieving the functions, features, interfaces and preferences described herein. Moreover, the scope of the present disclosure covers conventionally known manners for carrying out the described features and functions and interfaces, and those variations and modifications that may be made to the hardware or software or firmware components described herein as would be understood by those skilled in the art now and hereafter.

What is claimed is:

1. A method for designing a body-enhancing garment, the method comprising:

determining a 3-D body shape;

determining, by applying light to a model of the 3-D body shape, a 3-D brightness gradient created by the 3D body shape upon the application of the light;

creating a 2-D image of the 3-D brightness gradient; and applying a brightness gradient to a garment based on the 2-D image of the brightness gradient to form the body-enhancing garment.

2. The method of claim 1, wherein the applying the brightness gradient to the garment to form the body-enhancing garment is performed by a laser or printer.

3. The method of claim 1, wherein the applying the brightness gradient to the garment further comprising adjusting a brightness of the brightness gradient based on a size of the garment.

4. The method of claim 1, wherein the 3 -D body shape is for one or more different body portions.

5. The method of claim 4, wherein one or more different body portions are selected from a following group: a buttocks; a bosom; a waist; shoulders;

arms; thighs, or legs.

6. The method of claim 1, wherein the body-enhancing garment is one of:

a pair of pants; a shirt; a jacket; a pair of shorts; a skirt; a dress; a pair of leggings; a pair of capris; a bra; a piece of underwear; a piece of swim wear; a pair of shoes; and a pair of skorts.

7. The method of claim 1, wherein the brightness gradient is further adjusted based on accumulated consumer feedback.

8. The method of claim 1, wherein the applying the brightness gradient to the garment further comprises adjusting the brightness gradient based on a contrast range of the garment.

9. The method of claim 1, wherein the applying the brightness gradient to the garment further comprises adjusting the brightness gradient based on visual inspection of the brightness gradient as applied to an example garment being worn.

10. A method for designing a body-enhancing garment, the method comprising:

selecting a feature for anatomy shading;

determining a select appearance for the feature;

determining, based on an application of light on a model emulating the select appearance, one or more brightness gradients for changing a perception of the feature toward the select appearance based on rules of perception; and adding the one or more brightness gradients to a garment to form the body-enhancing garment.

11. The method of claim 10, wherein the adding the one or more brightness gradients to the garment to form the body-enhancing garment is performed by a laser or printer.

12. The method of claim 10, wherein the adding the one or more brightness gradients to the garment to form the body-enhancing garment comprises adjusting the one or more brightness gradients based on a size of the garment.

13. The method of claim 10, wherein the feature is for one or more different body portions.

14. The method of claim 13, wherein the feature is at least one of: a buttocks; a bosom; a waist; shoulders; arms; thighs, or legs.

15. The method of claim 10, wherein the body-enhancing garment is one of: a pair of pants; a shirt; a jacket; a pair of shorts; a skirt; a dress; a pair of leggings; a pair of capris; a bra; a piece of underwear; a piece of swim wear; a pair of shoes; and a pair of skorts.

16. The method of claim 10, wherein the one or more brightness gradients is further adjusted based on accumulated consumer feedback.

17. The method of claim 10, wherein the adding the one or more brightness gradients to the garment to form the body-enhancing garment comprises adjusting the one or more brightness gradients based on a contrast range of the garment.

18. The method of claim 10, wherein the adding the one or more brightness gradients to the garment to form the body-enhancing garment comprises adjusting the one or more brightness gradients based on visual inspection of the one or more brightness gradients applied to an example garment being worn.

19. The method of claim 1, wherein the model comprises an avatar, and wherein the application of light is simulated.

20. The method of claim 10, wherein the model comprises an avatar, and wherein the application of light is simulated.

* * * * *